United States Patent [19]

Asselman et al.

[11] 4,144,933

[45] Mar. 20, 1979

[54] HEAT EXCHANGER

[75] Inventors: George A. A. Asselman; Adrianus P. J. Castelijns, both of Eindhoven, Netherlands

[73] Assignee: U.S. Philips Corporation, New York, N.Y.

[21] Appl. No.: 433,386

[22] Filed: Jan. 14, 1974

[30] Foreign Application Priority Data

Oct. 31, 1973 [NL] Netherlands ..... 7314929

[51] Int. Cl.[2] ..... F28F 13/12

[52] U.S. Cl. ..... 165/124; 165/151; 165/153

[58] Field of Search ..... 244/57; 165/122, 124, 165/129, 148, 149, 151

[56] References Cited

U.S. PATENT DOCUMENTS

| | | | |
|---|---|---|---|
| 2,119,134 | 5/1938 | Karmazin | 165/151 X |
| 2,540,339 | 2/1951 | Kritzer | 165/151 |
| 4,034,804 | 7/1977 | Meijer et al. | 165/151 |

FOREIGN PATENT DOCUMENTS

| | | | |
|---|---|---|---|
| 47368 | 12/1936 | France | 165/122 |
| 517096 | 1/1940 | United Kingdom | 165/148 |

*Primary Examiner*—Charles J. Myhre
*Assistant Examiner*—Margaret A. LaTulip
*Attorney, Agent, or Firm*—David R. Treacy

[57] ABSTRACT

Apparatus for heat exchange between a fluid and air, having at least one heat exchanger element comprising a plurality of fluid tubes to which are secured heat transfer strips which define between them air passages having length ≦ 25 mm., hydraulic diameter < 2 mm, with each element being at an angle of at most 45° to the relative flow direction of the air before its entrance into the heat exchanger; at the rear of each element the strips are bent to extend in the discharge direction of the air issuing from the heat exchanger.

1 Claim, 7 Drawing Figures

HEAT EXCHANGER

BACKGROUND OF THE INVENTION

The invention relates to a heat exchanger, in particular a radiator, for exchanging heat between a fluid and air. Such a heat exchanger has at least one heat exchanger element which comprises a plurality of coplanar fluid tubes to which a plurality of strip-shaped heat transfer means are secured which extend transversely between the front and rear surfaces of the elements. These heat transfer means have a width $L \leqq 25$ mm, are spaced from one another by distances such that the air passages between the strips have a hydraulic diameter $d_h \leqq 2$ mm, with $L/d_h$ 25, and the elements are at an angle $\geqq 45°$ to the relative flow direction of the air before its entrance into the heat exchanger.

Heat exchangers of the type to which the present invention refers, are described in co-pending U.S. patent applications Ser. No. 379,708, now U.S. Pat. No. 4,034,804 and Ser. No. 419,631, now abandoned.

Owing to the inclined arrangement of the heat exchanger elements relative to the oncoming air, the small thickness of the elements and the fine structure, i.e. the small hydraulic diameter of the air passages between the strips, known heat exchangers have a very high heat exchange capacity per unit of front surface area.

This has the advantage that in cases where conventional flat heat exchangers are too bulky for the heat transfer capacity required, heat exchangers of the type referred to can still be used to advantage owing to their compact construction.

A surprising aspect of the aforedescribed type of heat exchanger is that in spite of the narrow flow passages for the air the heat exchanger is not choked by foreign matter such as dust, insects, etc. It has been found that this foreign matter is deflected along the surface of the inclined elements and is deposited at the rear of the heat exchanger, for example, in a collecting channel.

It has now been found that the distribution of the air flow over the heat exchanger elements is not uniform. A disproportionately large part of the air flows through that part of each element which is most remote from the air entrance face of the heat exchanger. Measurements have shown that in a known heat exchanger part of which is shown diagrammatically in FIG. 1 the air velocity in each of the elements is substantially zero at A and increases linearly towards B.

This effect is due to the fact that the direction of flow of the air emerging from the elements in principle is not parallel to the main flow direction of the air through the heat exchanger.

A direct consequence of the uneven flow of the air through the elements as compared with evenly distributed flow, is the occurrence of locally increased flow losses due to the higher discharge flow rate of the air from the elements at B and to the ensuing contraction (see at C in FIG. 1).

A further direct consequence is a reduced heat transfer capacity at a given temperature difference between the fluid in the tubes and air. This is due to higher flow losses in air which reduce the air mass flow at a given pressure difference across the heat exchanger; the uneven current distribution also results in reduced heat transfer so that the difference between the mean temperature of the strip-shaped heat transfer means and the mean air discharge temperature is greater than in the case of evenly distributed flow; owing to the uneven flow of air through the elements, the thermal load in the fluid side is concentrated in those fluid tubes which are more remote from the entrance face of the heat exchanger, with consequent increased differences between the mean fluid temperature and the mean wall temperature of the tubes.

All the aforementioned facts cause the heat exchanging capacity of the said heat exchanger to be reduced.

In order to obviate the aforementioned adverse effect it has already been proposed, in order to obtain even distribution of the air flow over each of the elements, to provide at least at the rear of the elements flow guides in the form of baffle plates which deflect the air issuing from the respective element to the direction in which it can flow on from the heat exchanger. Surprisingly it has now been found that the provision of such baffle plates causes the distribution of the air flow over the elements to become highly even, which results in a reduced pressure drop across the heat exchanger and an increased heat exchange capacity.

Under certain conditions baffle plates may be provided not only at the rear of the elements but also at their front.

The provision of the said baffle plates, however, apart from the said important advantages involves the disadvantage that the construction of the heat exchanger becomes slightly more complex.

It is an object of the present invention to provide a heat exchanger in which, while retaining even distribution of the air flow over each of the elements, the construction may be comparatively simple.

SUMMARY OF THE INVENTION

To achieve this object a heat exchanger according to the invention is characterized in that at least some of the strips or fins, are bent at the rear of each of the elements, only so that the bent ends extend in the discharge direction of the air flow from the heat exchanger.

Thus, without the need for separate baffle plates very good guidance of the air flow and consequently good distribution of the air flow over each of the elements are obtained.

Bending of the strips may readily be effected automatically during their manufacture.

A further advantageous embodiment of the heat exchanger according to the invention in which there are secured between the fluid tubes at least one strip which first is folded in zigzag and then is compressed, is characterized in that the zigzagging strips are bent at the rear of, each element, so that the bent parts at the rear extend parallel to one another, at least one non-bent part being provided between each pair of adjacent bent parts.

Embodiments of the invention will now be described, by way of example, with reference to the accompanying diagrammatic drawings:

DETAILED DESCRIPTION OF THE PREFERRED EMBODIMENT

Figure 1:
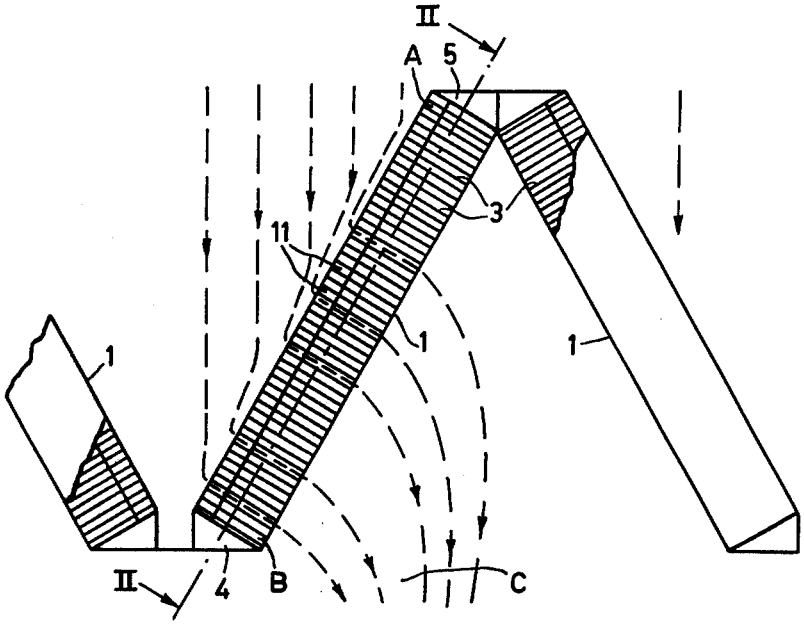
PRIOR ART Fig.1
FIG. 1 is a fragmentary, top sectional view of a heat exchanger of known construction.
Figure 2:
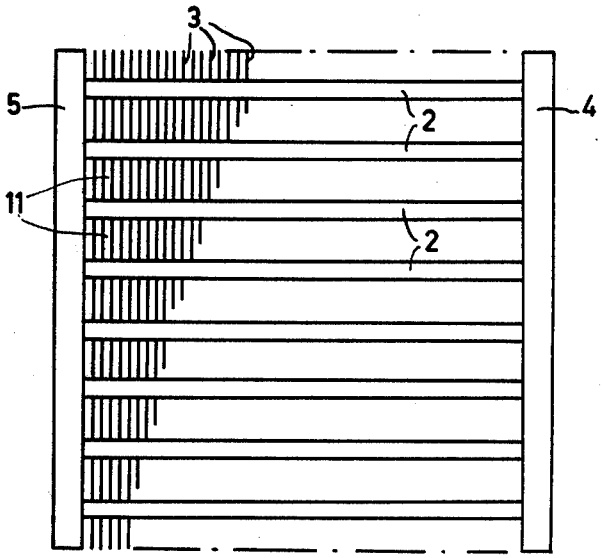
FIG. 2 is a front elevation sectional view taken along lines II—II of FIG. 1.

Referring now to FIGS. 1 and 2, the heat exchanger shown comprises a plurality of elements 1 which each have fluid tubes 2 to which metal strips 3 are secured in a thermally conducting manner. Each fluid tube 2 communicates at one end with a manifold 4 and at the other end with a manifold 5.

Between the strips 3 is formed a matrix of air passages 11, the hydraulic diameter $d_h$ of which is smaller than 2 mm while the length L, which is equal to the thickness of the elements 1, is smaller than 25 mm. In a practical embodiment $d_h$ is 0.44 mm and L is 4 mm. L and $d_h$ always is chosen so that $L/d_h$ is less than 25.

The flow lines along which the air passes through the heat exchanger are indicated in the drawing by broken lines in front of one of the elements. These lines clearly show how the air is deflected at the front surface of the element, and passes between the strips 3 of the element beyond a given point of the heat exchanger. It has been found that the air velocity between the strips is substantially zero at A and increases linearly towards B. This uneven distribution of the air flow over the element 1 gives rise to all the adverse effects set out hereinbefore.

Figure 3:
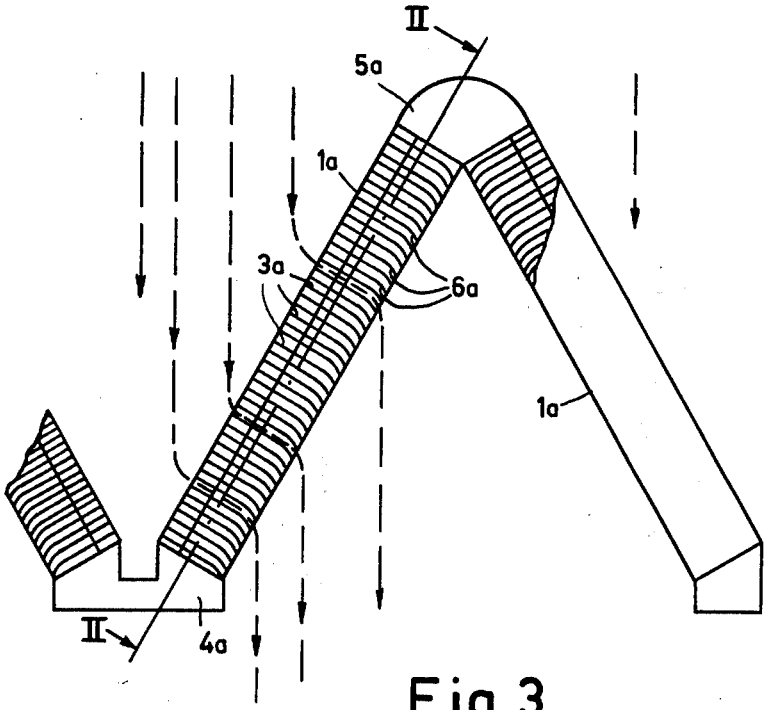
FIGS. 3 and 4 are sectional views similar to FIG. 1 showing other embodiments of heat exchangers in which the strips or fins are bent at the inlet and/or the exit of the respective elements.

The heat exchanger shown in FIG. 3 is substantially equal constructionally to that shown in FIGS. 1 and 2, with the sole difference that the strips 3*a* have been bent at the rear or exit of the elements 1*a* so that the bent edges 6*a* point in the direction in which the air flows out from the heat exchanger. It has been found that this simple step results in a substantially even distribution of the air flow through the elements 2*a*. Consequently the pressure drop across the heat exchanger may be reduced by 20%, while when the pressure drop is unchanged the heat dissipating capacity at the air side may be increased by 30%. Although in the embodiment shown in FIG. 3*a* each strip 3 is bent at its rear end, under certain conditions only some of the strips 3*a* are bent, for example each second or third or fourth strip; this depends for example upon the angle at which the elements 1*a* are situated to the oncoming air flow.

In the embodiment shown in FIG. 3 the strips 3*a* are bent at the rear 6*a* of the elements 1*a* only. A small improvement of the air flow distribution is obtainable by bending the strips in the direction of the incoming air flow at the front of the elements 1*a* also.

Figure 4:
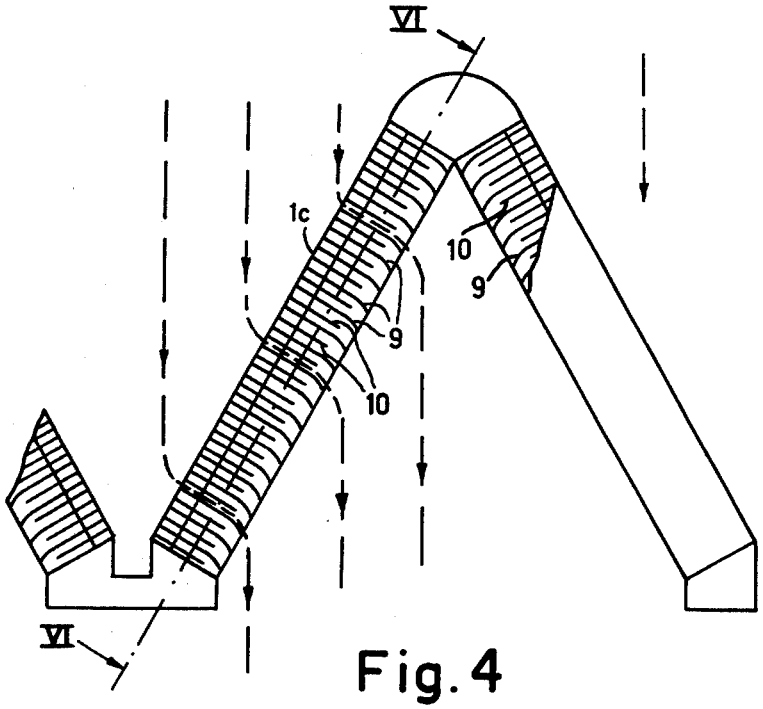
Figure 5:
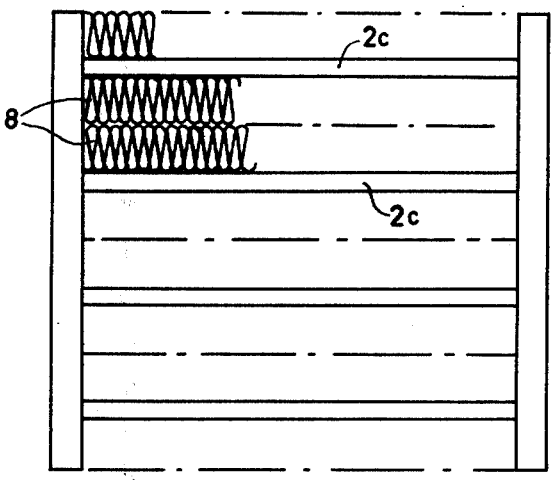
FIG. 5 is a sectional view similar to FIG. 2 taken along lines VI—VI of FIG. 4.

FIGS. 4 and 5 show schematically and not to scale part of an element 1*c* in which strips 8, which first have been folded in zigzag and then have been compressed to a grid, are interposed between the cooling passages 2*c* so as to be in thermally conducting contact with the passages 2*c*. As FIG. 4 shows, the zigzag parts of the strip grids 8 at the rear of the element 1*c* are alternately provided with a bent edge 9. The intermediate parts 10 are slightly shortened, because otherwise the flow openings are likely to be blocked. If desired, between each pair of adjacent bent parts more than one unbent and shortened part 10 may be provided, without satisfactory operation being adversely affected.

Figure 6:
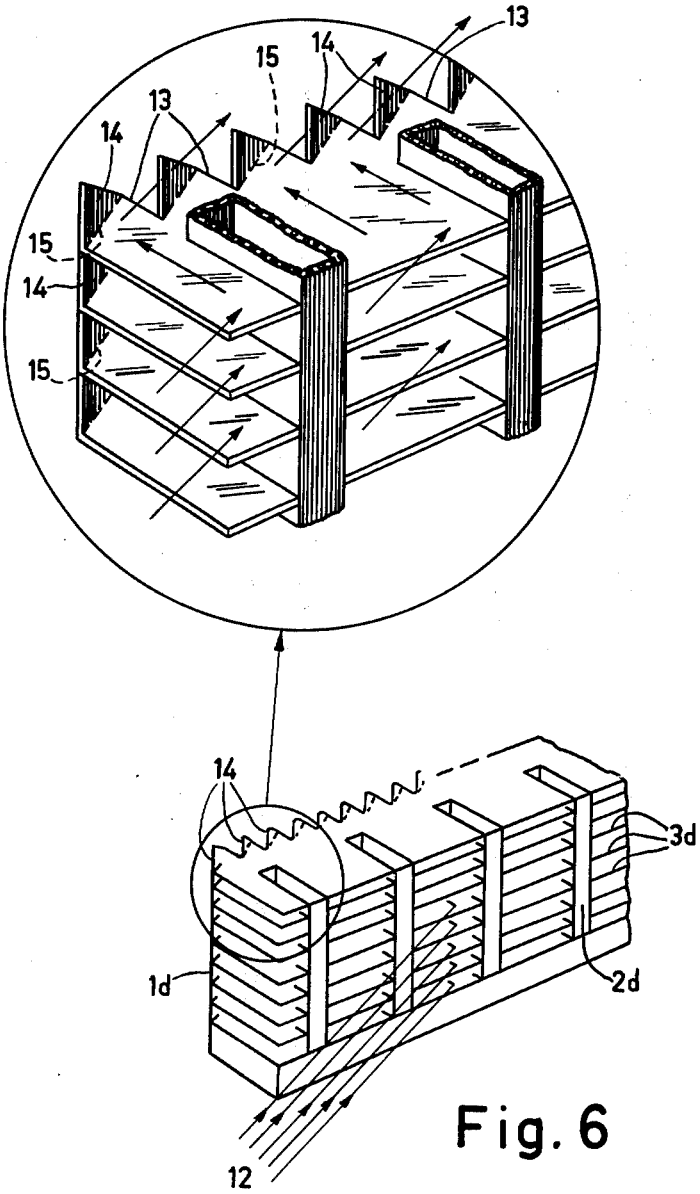
FIG. 6 is a fragmentary, perspective view of the heat exchanger of FIG. 1.

Finally FIG. 6 is a schematic perspective view of a part of an element 1*d* which comprises fluid tubes 2*d* between which strips 3*d* extend in this configuration strips 3*d* are arranged parallel to the direction of flow of the oncoming air 12. In this embodiment the strips 3*d* are notched along lines 13 at their rear ends and subsequently strip parts 14 situated between these lines are bent along lines 15, so that guide vanes for the air are effectively obtained which deflect the emerging air in the discharge direction.

Although in the drawings the parts 14 are sharply bent along straight lines, bending may also be effected so as to form smooth curves.

Thus satisfactory discharge guidance for the air is obtained so that in this embodiment also even distribution of the air flow over the elements is ensured.

What is claimed is:

1. A radiator operable with an entering gas flowing in a direction generally normal to a front reference plane, for cooling a quantity of liquid, the radiator formed of at least one heat-transfer element having a generally flat front part and a rear part, which comprises a plurality of pipes for said liquid, the pipes being spaced apart and defining a substantially flat wall, said front part of the element being inclined relative to said direction at an angle $\theta \leqq 45°$; and a multiplicity of fins extending transversely between and connected to said pipes in heat-transfer relationship with air passages defined between each pair of adjacent fins, a typical passage having length $L \leqq 25$ mm. in the direction of flow, hydraulic diameter $d_h \leqq 2$ mm., and the ratio $L/d_h < 25$, the passages having axes that are generally normal to said flat front part; said fins having corresponding entrance and exit parts, said exit parts only of a plurality of the fins being bent to extend generally in said direction of the entering gas flow for directing air exiting said passages, at least one shortened fin intermediate part being arranged between each of the adjacent fins having bent exit parts.

* * * * *